US006142769A

United States Patent [19]

Walker

[11] Patent Number: 6,142,769

[45] Date of Patent: Nov. 7, 2000

[54] MULTI-PURPOSE TOOL

[76] Inventor: Trevor Lee Walker, 1730 Jackson, San Francisco, Calif. 94109

[21] Appl. No.: 09/468,516

[22] Filed: Dec. 21, 1999

[51] Int. Cl.[7] ..... F23D 3/16; B25B 23/18

[52] U.S. Cl. ..... 431/253; 362/120; 362/119; 362/253; 81/3.45; 7/118; 7/158; 7/151; 7/155

[58] Field of Search ..... 431/253; 81/3.45; 7/118, 151, 155, 158; 362/118, 119, 120, 253

[56] References Cited

U.S. PATENT DOCUMENTS

| | | | |
|---|---|---|---|
| 653,807 | 7/1900 | Hofstetter . | |
| 1,273,026 | 7/1918 | Brown . | |
| 2,828,855 | 4/1958 | Mosch | 431/253 |
| 3,711,240 | 1/1973 | Warshaw | 431/253 |
| 4,437,359 | 3/1984 | Dejoux | 81/3.38 |
| 4,451,229 | 5/1984 | Nitta | 431/253 |
| 5,313,376 | 5/1994 | McIntosh | 362/119 |
| 5,653,525 | 8/1997 | Park | 431/253 |
| 5,829,965 | 11/1998 | Rubalcava | 431/253 |

FOREIGN PATENT DOCUMENTS

| | | | |
|---|---|---|---|
| 606520 | 8/1948 | United Kingdom | 431/253 |

*Primary Examiner*—Carl D. Price
*Attorney, Agent, or Firm*—Goldstein & Canino

[57] ABSTRACT

A multi-purpose tool including an elongated body portion. A plurality of tools are coupled with respect to the elongated body portion. The plurality of tools includes a serrated blade, a cork screw, a retractable pen, a refillable lighter, a bottle opener, and a flashlight.

5 Claims, 1 Drawing Sheet

MULTI-PURPOSE TOOL

BACKGROUND OF THE INVENTION

The present invention relates to a multi-purpose tool and more particularly pertains to enabling a waiter to accomplish a plurality of tasks with a single tool.

The use of combination tools is known in the prior art. More specifically, combination tools heretofore devised and utilized for the purpose of combining multiple tools into a single device are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,829,965 to Rubalcava discloses a waiter's tool comprised of a bottle opener, lighter, knife, and cork screw. U.S. Pat. No. 4,437,359 to Dejoux discloses a wine waiters tool comprised of a corkscrew, extraction lever and bottle opener. U.S. Pat. No. 653,807 to Hofstetter discloses a combined pencil holder and pen knife. U.S. Pat. No. 1,273,026 to Brown and U.S. Pat. No. 5,313,376 to McIntosh disclose additional combination tool assemblies.

While these devices fulfill their respective, particular objective and requirements, the aforementioned patents do not describe a multi-purpose tool for enabling a waiter to accomplish a plurality of tasks.

In this respect, the multi-purpose tool according to the present invention substantially departs from the conventional concepts and designs of the prior art, and in doing so provides an apparatus primarily developed for the purpose of enabling a waiter to accomplish a plurality of tasks.

Therefore, it can be appreciated that there exists a continuing need for a new and improved multi-purpose tool which can be used for enabling a waiter to accomplish a plurality of tasks. In this regard, the present invention substantially fulfills this need.

SUMMARY OF THE INVENTION

In the view of the foregoing disadvantages inherent in the known types of combination tools now present in the prior art, the present invention provides an improved multi-purpose tool. As such, the general purpose of the present invention, which will be described subsequently in greater detail, is to provide a new and improved multi-purpose tool which has all the advantages of the prior art and none of the disadvantages.

To attain this, the present invention essentially comprises an elongated body portion having a generally rectangular configuration. The body portion has planar opposed upper and lower narrow faces, planar opposed wide side faces, a rounded forward end, and a rounded rearward end. The upper face has a long recess formed therein. The lower face has a deep recess formed therein. The forward end has an opening therein. The rearward end has an opening therein. The wide side faces each have gripping pads disposed thereon inwardly of the rounded forward end. A serrated blade is hingedly coupled the upper face of the body portion. The serrated blade is dimensioned for positioning within the long recess in the upper face in a stored orientation. A cork screw is hingedly coupled with the lower face of the body portion. The cork screw is dimensioned for positioning within the deep recess in the lower face in a stored orientation. A retractable pen is disposed within the opening in the forward end of the body portion. The retractable pen has a control switch disposed within one of the side faces of the body portion for selectively extending and retracting the pen with respect to the body portion. A refillable lighter is disposed within the opening in the rearward end of the body portion. A bottle opener is hingedly coupled with the rearward end of the body portion. A flashlight is disposed within the forward end of the body portion. The flashlight has an activation switch disposed within one of the side faces of the body portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-purpose tool which has all the advantages of the prior art combination tools and none of the disadvantages.

It is another object of the present invention to provide a new and improved multi-purpose tool which may be easily and efficiently manufactured and marketed.

It is a further object of the present invention to provide a new and improved multi-purpose tool which is of durable and reliable construction.

An even further object of the present invention is to provide a new and improved multi-purpose tool which is susceptible of a low cost of manufacture with regard to both materials and labor, and which accordingly is then susceptible of low prices of sale to the consuming public, thereby making such a multi-purpose tool economically available to the buying public.

Even still another object of the present invention is to provide a new and improved multi-purpose tool for enabling a waiter to accomplish a plurality of tasks.

Lastly, it is an object of the present invention to provide a new and improved multi-purpose tool including an elongated body portion. A plurality of tools are coupled with respect to the elongated body portion. The plurality of tools includes a serrated blade, a cork screw, a retractable pen, a refillable lighter, a bottle opener, and a flashlight.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
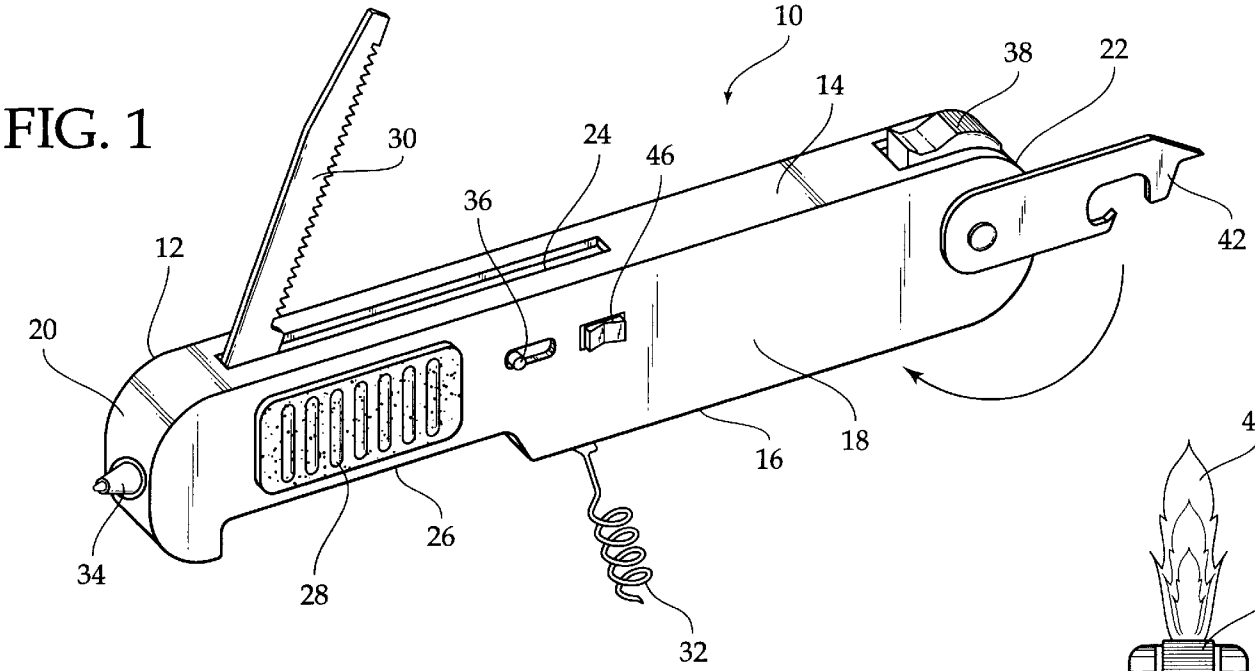
FIG. 1 is a perspective view of the preferred embodiment of the multi-purpose tool constructed in accordance with the principles of the present invention.
Figure 2:
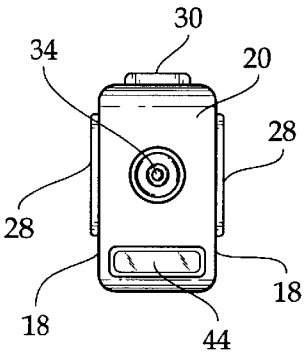
FIG. 2 is an elevated end view of the present invention.
Figure 3:
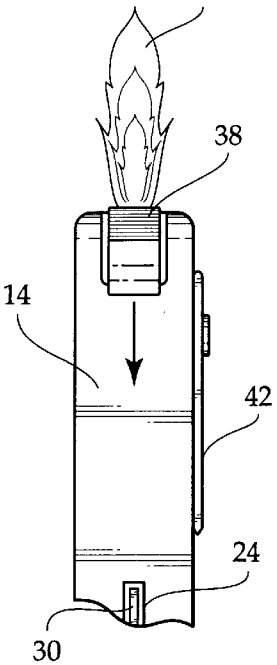
FIG. 3 is a partial plan view of the present invention.

With reference now to the drawings, and in particular, to FIGS. 1 through 3 thereof, the preferred embodiment of the new and improved multi-purpose tool embodying the principles and concepts of the present invention and generally designated by the reference number 10 will be described.

Specifically, it will be noted in the various Figures that the device relates to a multi-purpose tool for enabling a waiter to accomplish a plurality of tasks. In its broadest context, the device consists of a body portion, a serrated blade, a cork screw, a retractable pen, a refillable lighter, a bottle opener, and a flashlight. Such components are individually configured and correlated with respect to each other so as to attain the desired objective.

The elongated body portion 12 has a generally rectangular configuration. The body portion 12 has planar opposed upper and lower narrow faces 14,16, planar opposed wide side faces 18, a rounded forward end 20, and a rounded rearward end 22. The upper face 14 has a long recess 24 formed therein. The lower face 16 has a deep recess 26 formed therein. The forward end 20 has an opening therein. The rearward end 22 has an opening therein. The wide side faces 18 each have gripping pads 28 disposed thereon inwardly of the rounded forward end 20.

The serrated blade 30 is hingedly coupled the upper face 14 of the body portion 12. The serrated blade 30 is dimensioned for positioning within the long recess 24 in the upper face 14 in a stored orientation. The blade 30 can be extended outwardly for use in cutting objects, such as wine bottle wrappings. After use, the blade 30 can be safely stored within the long recess 24.

The cork screw 32 is hingedly coupled with the lower face 16 of the body portion 12. The cork screw 32 is dimensioned for positioning within the deep recess 26 in the lower face 16 in a stored orientation. The cork screw 32 will be used to remove corks from bottles in the normal manner.

The retractable pen 34 is disposed within the opening in the forward end 20 of the body portion 12. The retractable pen 34 has a control switch 36 disposed within one of the side faces 18 of the body portion 12 for selectively extending and retracting the pen 34 with respect to the body portion 12. The control switch 36 allows the pen to be retracted within the body portion 12 when not in use. The gripping pads 28 on the side faces 18 will enable the user to grip the device 10 so as to write effectively.

The refillable lighter 38 is disposed within the opening in the rearward end 22 of the body portion 12. The lighter 38 includes a thumb control which will enable a flame 40 to be created. Note FIG. 3.

The bottle opener 42 is hingedly coupled with the rearward end 22 of the body portion 12. The bottle opener 42 enables bottle tops to be easily removed.

The flashlight 44 is disposed within the forward end 20 of the body portion 12. The flashlight 44 has an activation switch 46 disposed within one of the side faces 18 of the body portion 12. The activation switch 46 will allow the flashlight 44 to be turned on and off.

The device 10 is a handy multi-purpose tool that can easily fit within a pocket of a waiter or other server. The device 10 will enable multiple tasks to be accomplished in a quick effective manner that is critical in the service industry.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A multi-purpose tool for enabling a waiter to accomplish a plurality of tasks comprising, in combination:

an elongated body portion having a generally rectangular configuration, the body portion having planar opposed upper and lower narrow faces, planar opposed wide side faces, a rounded forward end, and a rounded rearward end, the upper face having a long recess formed therein, the lower face having a deep recess formed therein, the forward end having an opening therein, the rearward end having an opening therein, the wide side faces each having gripping pads disposed thereon inwardly of the rounded forward end;

a serrated blade hingedly coupled the upper face of the body portion, the serrated blade being dimensioned for positioning within the long recess in the upper face in a stored orientation;

a cork screw hingedly coupled with the lower face of the body portion, the cork screw being dimensioned for positioning within the deep recess in the lower face in a stored orientation;

a retractable pen disposed within the opening in the forward end of the body portion, the retractable pen having a control switch disposed within one of the side faces of the body portion for selectively extending and retracting the pen with respect to the body portion;

a refillable lighter disposed within the opening in the rearward end of the body portion;

a bottle opener hingedly coupled with the rearward end of the body portion;

a flashlight disposed within the forward end of the body portion, the flashlight having an activation switch disposed within one of the side faces of the body portion.

2. A multi-purpose tool for enabling a waiter to accomplish a plurality of tasks comprising, in combination:

an elongated body portion;

a plurality of tools coupled with respect to the elongated body portion, the plurality of tools including a serrated blade, a cork screw, a retractable pen, a refillable lighter, a bottle opener, and a flashlight.

3. The multi-purposed tool as set forth in claim 2 wherein the elongated body portion having a generally rectangular configuration, the body portion having planar opposed upper and lower narrow faces, planar opposed wide side faces, a rounded forward end, and a rounded rearward end, the upper face having a long recess formed therein, the lower face having a deep recess formed therein, the forward end having an opening therein, the rearward end having an opening therein.

4. The multi-purpose tool as set forth in claim 3 wherein the bottle opener is hingedly coupled with the rearward end of the body portion.

5. The multi-purpose tool as set forth in claim 3 wherein the flashlight is disposed within the forward end of the body portion, the flashlight having an activation switch disposed within one of the side faces of the body portion.

* * * * *